US007195549B2

(12) United States Patent
Baldoni et al.

(10) Patent No.: US 7,195,549 B2
(45) Date of Patent: Mar. 27, 2007

(54) DRUM GRINDING WHEEL

(75) Inventors: J. Gary Baldoni, Norfolk, MA (US); Sergej-Tomislav Buljan, Acton, MA (US); Eric M. Schulz, Worcester, MA (US)

(73) Assignee: Saint-Gobain Abrasives, Inc., Worcester, MA (US)

( * ) Notice: Subject to any disclaimer, the term of this patent is extended or adjusted under 35 U.S.C. 154(b) by 248 days.

(21) Appl. No.: 10/924,027

(22) Filed: Aug. 23, 2004

(65) Prior Publication Data

US 2006/0040601 A1 Feb. 23, 2006

(51) Int. Cl.
*B34D 5/06* (2006.01)

(52) U.S. Cl. ..... 451/541

(58) Field of Classification Search ..... 451/541, 451/542, 543, 544, 546, 547, 180
See application file for complete search history.

(56) References Cited

U.S. PATENT DOCUMENTS 3,648,413 A 3/1972 Godwin et al.
4,581,798 A * 4/1986 Yamamoto ..... 451/541
6,024,635 A * 2/2000 Cruickshank et al. ..... 451/541

FOREIGN PATENT DOCUMENTS

| | | |
|---|---|---|
| EP | 0 144 468 | 5/1983 |
| EP | 0 945 220 | 9/1999 |
| GB | 333 658 | 8/1930 |
| GB | 1 276 204 | 6/1972 |

* cited by examiner

*Primary Examiner*—Jacob K. Ackun, Jr.
(74) *Attorney, Agent, or Firm*—Sampson & Associates, P.C.

(57) ABSTRACT

A drum grinding wheel includes an elongated drum configured for coaxial engagement with a spindle of a grinding machine. An exterior surface of the drum extends parallel to a central axis, and a plurality of removable cutters are removably fastened to the exterior surface. Each of the cutters has a plurality of ribs disposed in spaced relation thereon, and abrasive grain is disposed on a grinding face of each of the ribs, such as by use of a metallic braze.

25 Claims, 5 Drawing Sheets

DRUM GRINDING WHEEL

BACKGROUND

1. Technical Field

This invention relates to drum grinding wheels, and more particularly to drum grinding wheels having cutters that are mechanically fastened to a reusable drum.

2. Background Information

Drum grinding wheels are commonly used for diverse grinding operations ranging, for example, from grinding automobile brake blocks or pads and shoes or grinding other composite materials, to centerless grinding operations. Drum grinding wheels suitable for these applications have typically been manufactured by machining ribs into a right cylinder, welding or mechanically attaching end caps onto the cylinder, applying braze and diamond abrasive to the ribs, and then firing the entire assembly in a vacuum furnace.

These wheels eventually wear due to use, at which time they are either discarded, or re-furbished. As these grinding wheels tend to be relatively large, e.g., on the order of 25 cm×25 cm or larger, their disposal may be costly and cumbersome, even in the event portions thereof are recycled.

Re-furbishing, on the other hand, typically involves stripping the braze and any remaining abrasive from the ribs, recoating the ribs with new braze and abrasive, and then re-firing the wheel. While this re-furbishing dramatically extends the useful life of the wheel, the process tends to be cumbersome, as the user must generally ship the entire wheel back to the wheel manufacturer or to third party refurbishers. Refurbishing is also relatively time consuming, particularly when one considers the time required for round-trip ground shipping. Accordingly, users must generally keep replacement wheels on hand to mitigate costly down-time associated with wheel replacement. Storage of replacement wheels, however, disadvantageously tends to increase inventory costs.

Moreover, the effective diameter of the grinding wheel cannot easily be changed, which often requires users to stock wheels of various diameters in order to accommodate various grinding needs. Disadvantageously, this tends to further increase inventory costs.

A need therefore exists for an improved drum grinding wheel that addresses the aforementioned drawbacks.

SUMMARY

In one aspect of the invention, a drum grinding wheel includes an elongated drum configured for coaxial engagement with a spindle of a grinding machine. The drum has an exterior surface extending parallel to a central axis. A plurality of removable cutters are removably fastened to the exterior surface, each of the cutters having a plurality of ribs disposed in spaced relation thereon. Abrasive grain is disposed on a grinding face of each of the ribs.

In another aspect of the invention, a drum grinding wheel includes an elongated drum configured for coaxial engagement with a spindle of a grinding machine. The drum has an exterior surface extending parallel to a central axis.

A plurality of cutters are fastened to the exterior surface, and abrasive grain is secured by a metallic braze to a grinding face of each of the cutters.

Still another aspect of the invention includes a method for fabricating a drum grinding wheel. The method includes providing and configuring an elongated drum for coaxial engagement with a spindle of a grinding machine. The drum is provided with an exterior surface extending 360 degrees about, and parallel to, a central axis. A plurality of abrasive cutters is provided, and the cutters are configured for being fastened to the exterior surface.

In yet another aspect of the invention, a method is provided for drum grinding. The method includes removably securing a plurality of abrasive cutters to an exterior surface extending 360 degrees about a central axis of an elongated drum to form a drum grinding wheel. The drum is coaxially engaged with the grinding machine. With the grinding machine, the drum is rotated about its central axis.

The cutters of the rotating grinding wheel are engaged with a work piece. The cutters may then be removed from the drum, and the foregoing steps repeated with new cutters.

In a further aspect of the invention, a drum grinding wheel includes elongated drum means configured for coaxial engagement with a spindle of a grinding machine. The drum means has an exterior mounting means extending 360 degrees about, and parallel to, a central axis. A plurality of cutting means are fastened to the exterior mounting means. The cutting means has abrasive means disposed on a grinding face portion thereof.

BRIEF DESCRIPTION OF THE DRAWINGS

The above and other features and advantages of this invention will be more readily apparent from a reading of the following detailed description of various aspects of the invention taken in conjunction with the accompanying drawings, in which.

DETAILED DESCRIPTION

Figure 1:
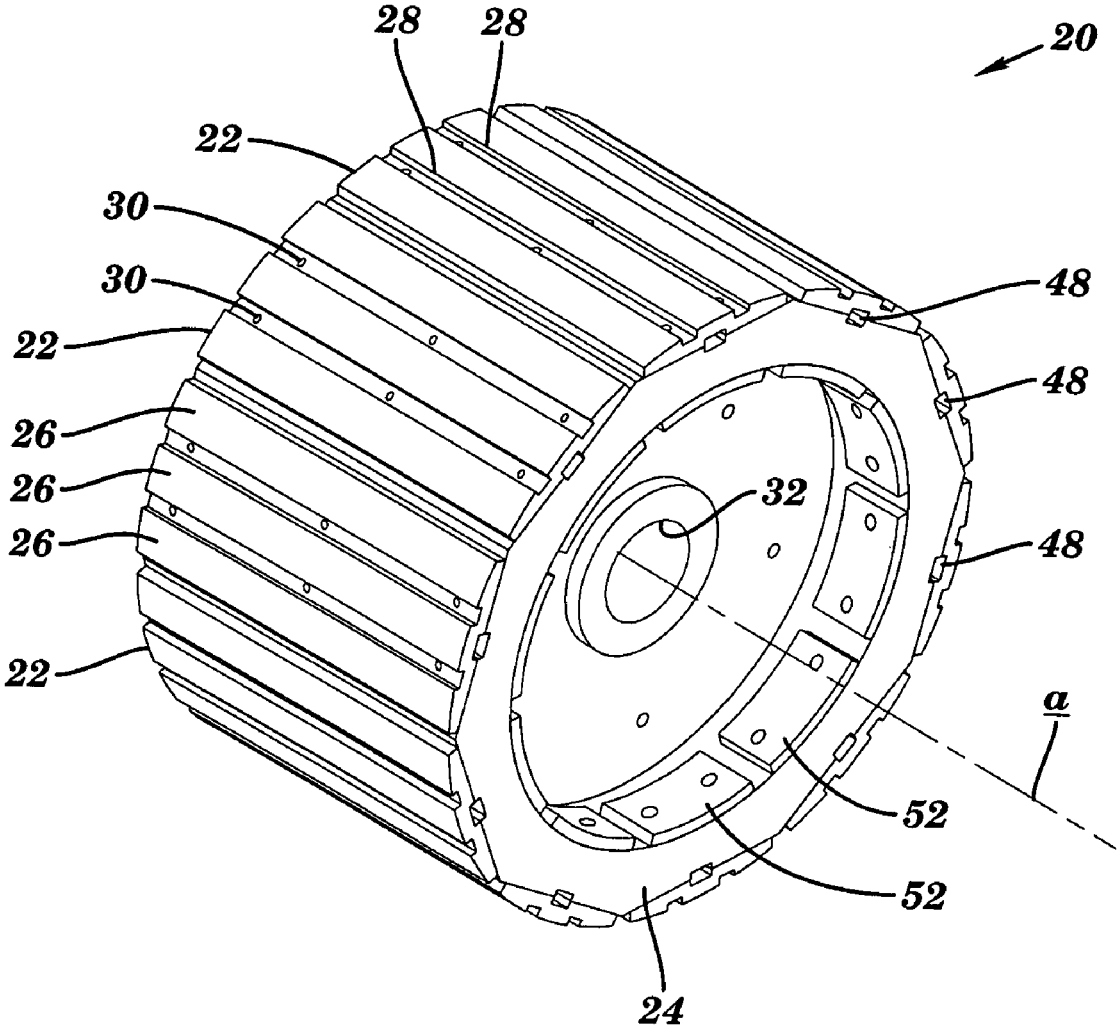
FIG. 1 is a perspective view of an embodiment of the present invention.

In the following detailed description, reference is made to the accompanying drawings that form a part hereof, and in which is shown by way of illustration, specific embodiments in which the invention may be practiced. These embodiments are described in sufficient detail to enable those skilled in the art to practice the invention, and it is to be understood that other embodiments may be utilized. It is also to be understood that structural, procedural and system changes may be made without departing from the spirit and scope of the present invention. The following detailed description is, therefore, not to be taken in a limiting sense, and the scope of the present invention is defined by the appended claims and their equivalents. For clarity of exposition, like features shown in the accompanying drawings shall be indicated with like reference numerals and similar features as shown in alternate embodiments in the drawings shall be indicated with similar reference numerals.

An aspect of the instant invention was the realization that drum grinding wheels having a series of circumferentially disposed cutters or segments may be used safely in spite of prevailing wisdom to the contrary. Although segmented grinding wheels had been known, heretofore such wheels had generally been of the cylinder or cup type (e.g., ANSI Types 2, 6, 11), in which their grinding faces extend orthogonally to their axes of rotation. As such, these segments are relatively easy to secure, such as by use of a first set of supports or abutments placed radially outward of the segments, to help the segments resist centripetal (also known as centrifugal) forces during grinding operations.

The inability to place similar retaining structures radially outward of removable segments on a drum ostensibly led to the perception that they would be difficult or impossible to safely secure, particularly given the relatively large diameters (e.g., 40 cm or more) and high rotational speeds (e.g., 1200–1400 rpm or more) associated with many conventional drum wheels. Contrary to these expectations however, embodiments of the present invention have proven surprisingly successful.

Referring to the appended figures, embodiments of the present invention are shown and described. Briefly, these embodiments include a drum grinding wheel 20 in which cutters 22 are mechanically fastened to a reusable drum 24. In particular embodiments, cutters 22 include ribs 26 having a layer of abrasive grain 28 secured by metal bond (e.g., brazed or electroplated) thereto. In this configuration, the cutters 22 may be conveniently replaced when they become worn.

This embodiment thus eliminates the need for discarding or refurbishing the entire grinding wheel once the cutters 22 reach the end of their useful life. Rather, once the cutters 22 wear out, they may be quickly and easily removed from drum 24 and replaced with new cutters 22. This cutter replacement may be conveniently effected by the user, to enable the wheel to be re-used multiple times, without having to ship the entire wheel 20 to third parties.

Thus, in addition to eliminating potential downtime associated with refurbishing, inventory costs are also lowered by enabling users to simply store replacement cutters, rather than entire spare grinding wheels. Moreover, embodiments of the invention also tend to eliminate the need for storing wheels of multiple diameters, since the effective diameter of the grinding wheel of the invention may be altered simply by the selection of cutters. The drum diameter, and hence the radius of the part being ground, may be changed by mechanically attaching cutters 22 of different height and/or curvature to the drum 24. Thus, grinding wheels of various distinct diameters may be configured using a single drum 24. This aspect tends to further reduce inventory costs relative to those associated with prior art wheels.

Where used in this disclosure, the term "axial" refers to a direction relative to an element, which is substantially parallel to axis of rotation a when the element is installed on a drum wheel as shown in FIG. 1. Similarly, the term "transverse" refers to a direction other than substantially parallel to the axial direction. The terms "transverse cross-section" or "transverse circumference" refer to a cross-section or circumference, respectively, taken along a transverse plane.

Embodiments of the present invention will now be more thoroughly described with reference to the attached figures. As shown in FIG. 1, a drum grinding wheel 20 of the present invention is generally configured in the form of a cylinder having a central axis a, and a central bore 32 configured for coaxial engagement with a spindle of a conventional grinding machine (not shown). A series of cutters (or segments) 22 are removably secured to drum (or core) 24 to define an exterior, substantially cylindrical, grinding face of wheel 20.

In the embodiment shown, cutters 22 each include a series of elongated ribs 26 having a layer 28 of abrasive grain and bond disposed thereon. Layer 28 may conveniently include conventional metal bond material, such as braze or electroplating, to secure the grain. However, it is contemplated that substantially any approach may be used to secure abrasive grain to the cutters 22. A metal braze is preferred for securing the abrasive grain to the cutter. Moreover, although ribs 26 are elongated in a direction nominally parallel to the axis a, they may extend in substantially any direction, including obliquely or orthogonally to axis a, without departing from the spirit and scope of the present invention.

Figure 2:
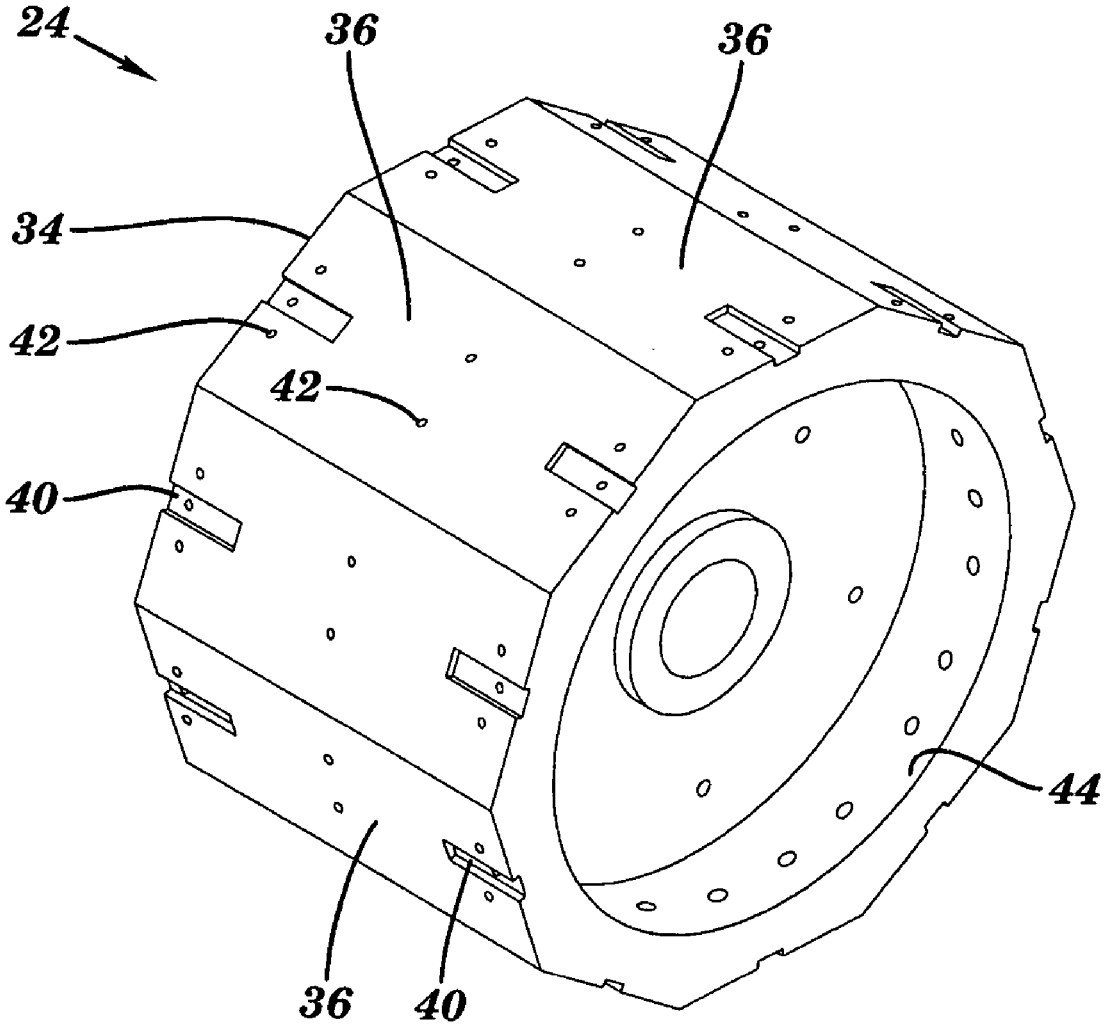
FIG. 2 is a perspective view of a component of the embodiment of FIG. 1.

Turning now to FIG. 2, drum (core) 24 is fabricated in a conventional manner, such as by machining or molding, from a suitable structural material. Examples of such materials include steel, aluminum, bronze, titanium, and INCONEL® nickel alloy (Huntington Alloys Corporation, West Virginia) and alloys thereof. Non-metallic materials such as carbon fiber composites may also be used in some applications. In the embodiment shown, drum 24 is provided with an exterior surface 34 of polygonal (e.g., decagon, in the embodiment shown) transverse cross-section. Each side of the polygonal cross-section of surface 34 defines an engagement surface 36 for at least one of the cutters 22, as discussed in greater detail below.

As also shown, each engagement surface 36 includes a pair of keyways 40 (discussed in greater detail below) formed as channels extending substantially parallel to central axis a. A series of bores 42 also pass through surfaces 36, extending radially inward through cylindrical interior surface 44. Bores 42 are each sized to receive a mechanical fastener 30 therein as discussed below.

Figure 3:
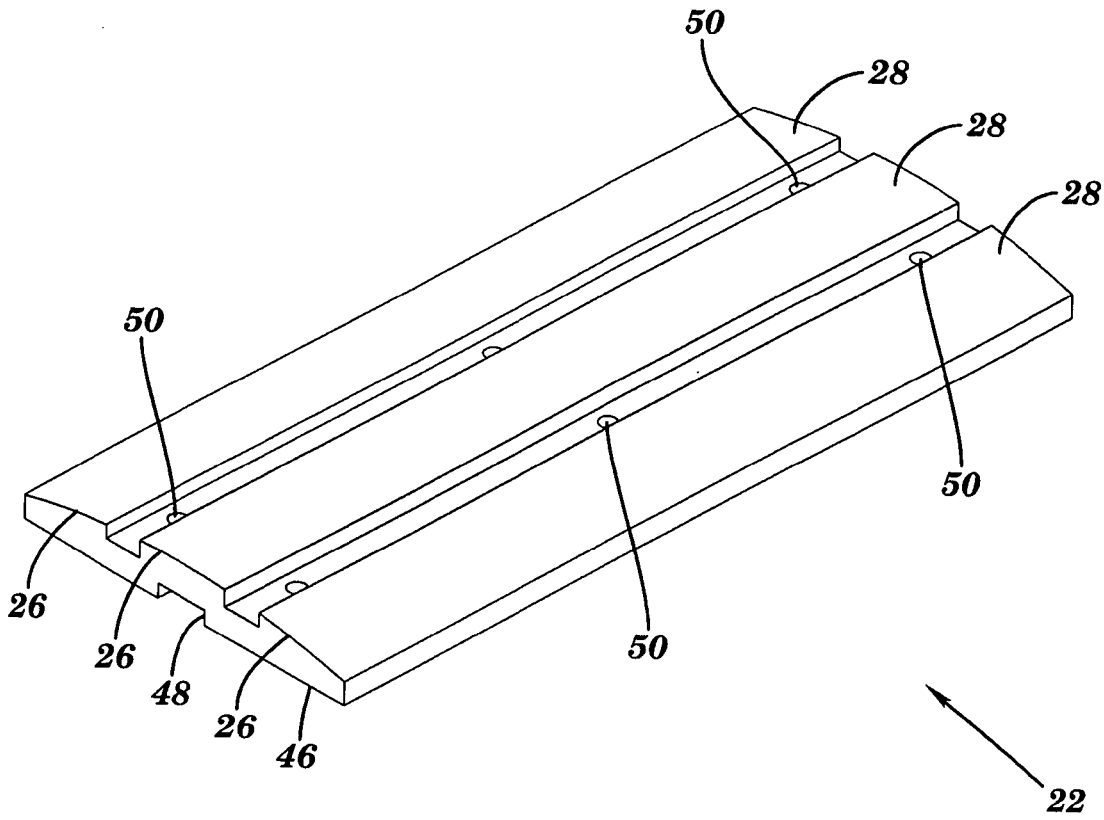
FIG. 3 is a perspective view, on an enlarged scale, of another component of the embodiment of FIG. 1.

Referring now to FIG. 3, an embodiment of cutter 22 is shown in greater detail. This cutter may be fabricated from nominally any structural material, and in the embodiment shown, semi refractory material (i.e., a material capable of withstanding the firing temperatures typically associated with the metal bond of abrasive layer 28). Exemplary materials include steel, aluminum, bronze, titanium, INCONEL® nickel alloy, and alloys thereof. The skilled artisan will recognize, however, that non-semi refractory materials (e.g., those of relatively lower melting points) may be used in the event layer 28 is formed without the need to fire the cutter. For cutters made by brazing grain, or made by another thermal process carried out at a temperature in excess of 600° C., preferred materials include steel, titanium and INCONEL® alloy.

Figure 4:
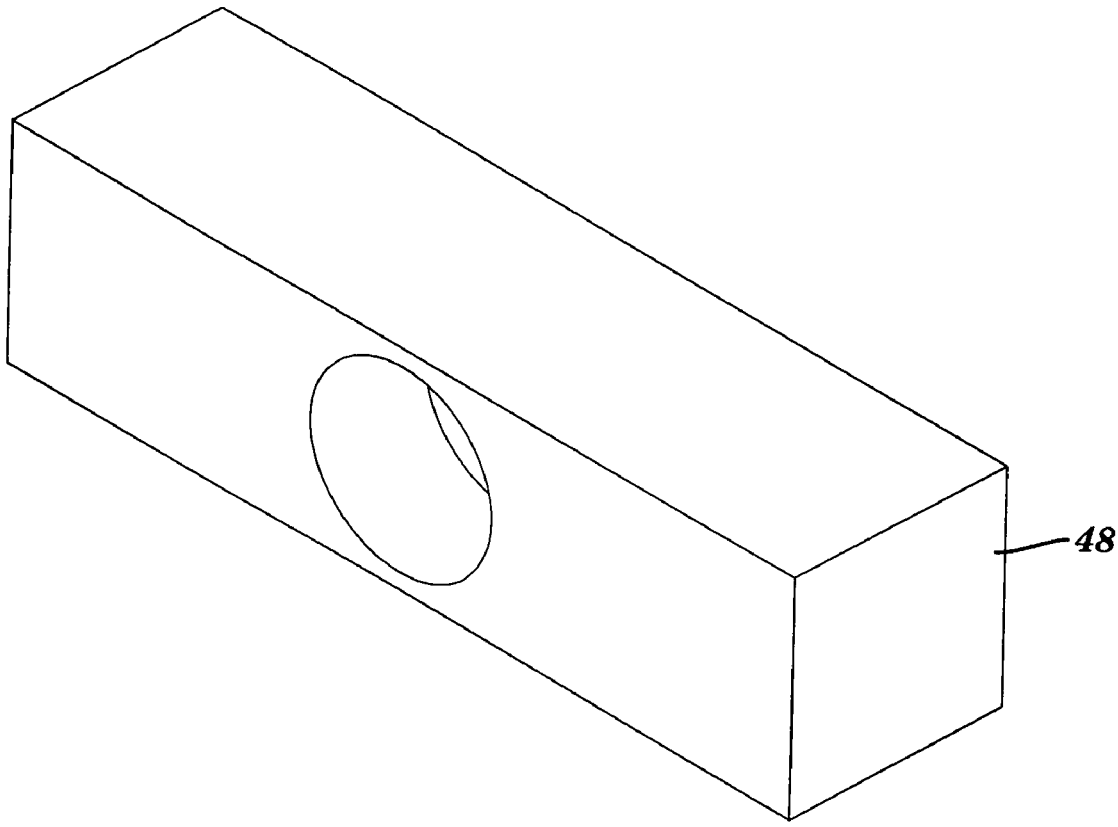
FIG. 4 is a perspective view, on a further enlarged scale, of another component of the embodiment of FIG. 1.
Figure 5:
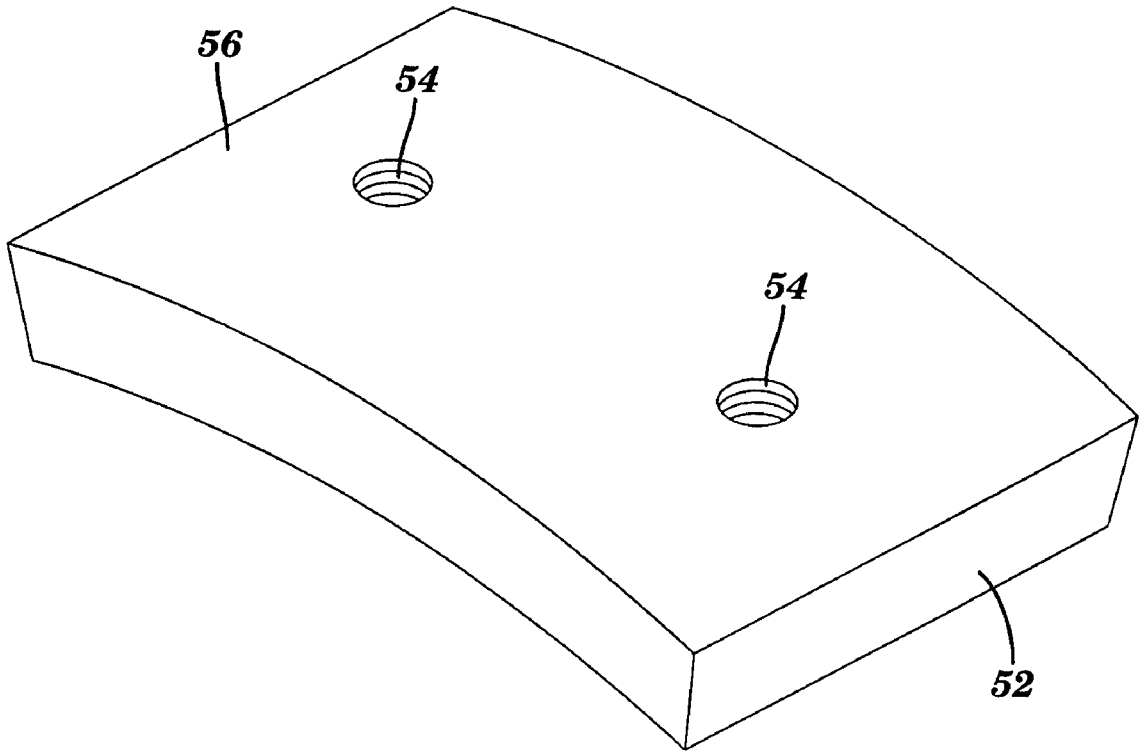
FIG. 5 is a view similar to that of FIG. 3, of another component of the embodiment of FIG. 1.

As discussed above, each cutter 22 has a plurality of ribs 26 extending longitudinally thereon. Abrasive layer 28 is disposed on an exterior surface of each rib 26 to define a grinding face. As also shown, each cutter has a base 46, e.g., configured as a substantially flat surface, for engagement with one of the engagement surfaces 36 of drum 24. Base 46 includes a recessed keyway 48 which is substantially similar to, though configured in a mirror image of, keyway 40 of drum 24. Keyways 40 and 48 are thus sized, shaped, and located so that they are superposed with one another to receive a key 48 (FIGS. 1 & 4) therein when cutters 22 are properly fastened to drum 24 as discussed below. This engagement of key 48 with keyways 40 and 48 advantageously enables the cutters 22 to resist the shear forces generated during grinding.

As also shown, the ribs 26 of each cutter 22 including abrasive layer 28, collectively define an arcuate surface configured to form a portion of the exterior cylindrical grinding face of grinding wheel 20 (FIG. 1). The ribs are thus configured so that upon installation on drum (core) 24, their radially outermost surfaces are disposed at a predetermined radius from central axis a. This configuration enables the circumferentially spaced ribs 26 to define a circumferentially continuous notional cylinder during operational rotation of the wheel 20. In this regard, however, it should be recognized that ribs 26 may be disposed at substantially any circumferential spacing, ranging, for example, from variable spacing to little or no spacing therebetween (e.g., to form a nominally continuous circumferential surface), while remaining within the scope of the present invention.

Moreover, in the particular embodiment shown, cutters 22 are disposed in substantially abutting relationship to one another, to collectively extend substantially continuously in the circumferential direction as best shown in FIG. 1. It should be recognized, however, that the cutters themselves may be circumferentially spaced from one another without departing from the spirit and scope of the present invention.

Moreover, each cutter 22 is shown fastened to a single engagement surface 36. However, various alternate configurations are possible, such as placement of multiple cutters on a single surface 36. Alternatively, it is conceivable that a cutter may be configured to effectively straddle two or more surfaces 36. Still further, although shown as being flat, engagement surfaces 36 may be provided with nominally any desired topography, e.g., circular or triangular topography, provided the cutters 22 are suitably configured for engagement thereto.

Referring now to FIGS. 1, 2, 3 & 5, as discussed above, cutters 22 are configured to be removably fastened to drum 24. In the embodiment shown, this is accomplished by the provision of counter-sunk bores 50 extending through the cutters at positions predetermined to align with bores 42 of the drum. Conventional threaded fasteners 30 are received within coaxially aligned bores 50 and 42, and secured using nuts 52. In this representative embodiment, nuts 52 extend circumferentially to receive at least two fasteners 30 within threaded bores 54. Nuts 52 are also provided with a surface 56 sized and shaped (in this example, arcuately) for surface-to-surface engagement with inner cylindrical surface 44 (FIG. 1) of drum 24. Those skilled in the art will recognize that this construction facilitates installation and replacement of cutters 22, as the receipt of two bolts tends to prevent the nuts from rotating during tightening. The relatively large surface area of the nuts also advantageously distributes the load of the carried by the bolts. However, conventional nuts (e.g., hex nuts) may also be used in particular embodiments.

As discussed above, cutters 22 may be provided in sets of various (radial) thicknesses. This advantageously enables a single drum 24 to form grinding wheels 20 of various diameters.

As also mentioned above, cutters 22 include an abrasive layer 28. Abrasive grain used in layer 28 may include nominally any abrasive or superabrasive, including diamond, CBN (cubic boron nitride), fused alumina, sintered alumina, aluminum oxynitride, zirconia-alumina, silicon carbide, boron carbide, tungsten carbide, or any other conventional abrasive grain, alone or in combination. Other abrasives include carbides and nitrides of transition metals of Groups IV, V and VI, and combinations and solid solutions thereof.

In particular embodiments, a single layer of the selected abrasive grain is secured to cutters 22 using a metal bond matrix. Substantially any conventional braze materials may be used for this bond, including bronze, nickel, and combinations and alloys thereof. For example, a bronze alloy including copper, silver, chromium, and titanium, iron and tungsten and combinations thereof may be used.

In alternate embodiments, the metal bond may include electroplated metal. Nominally any metal commonly used for electroplating may be used, such as, nickel, copper, cobalt, silver, tin and chromium, and combinations and alloys thereof. Useful alloys include brass, bronze, nickel-iron and nickel-tin.

A particular embodiment of the invention having been described, the following is a description of the operation thereof. Referring to Table I, in step 60, a user removably secures a plurality of cutters 22 to the exterior surface of drum 24 to form a drum grinding wheel 20. At 62, the drum is coaxially engaged with a spindle of a grinding machine. The grinding machine may then be operated 64 in a conventional manner to grind 66 a workpiece. Once the cutters have worn, or the grinding operation has been completed, they may be removed 68 by the user, whereupon at 70, steps 60–66 may be repeated with new cutters 22.

TABLE I

| | |
|---|---|
| 60 | Removably secure cutters to drum |
| 62 | Secure drum to grinding machine |
| 64 | Operate grinding machine |
| 66 | Engage cutters with workpiece |
| 68 | Remove worn cutters |
| 70 | Repeat 60–66 with new cutters |

The following illustrative example is intended to demonstrate certain aspects of the present invention. It is to be understood that this example should not be construed as limiting.

EXAMPLE 1

A wheel was fabricated substantially as described above with respect to FIGS. 1–5, with a drum 24 machined from 7075 T6 aluminum, having a maximum diameter of 15.5 inches (39.4 cm), an inner diameter (inner surface 44) of 12 inches (30.5 cm), and an axial dimension of 9.5 inches (24.1 cm).

Cutters 22 were fabricated from 1018 steel, measuring 9.5 in (24.1 cm) axially, by 4.5 in (11.4 cm), and a radial thickness ranging from 0.25 in (0.64 cm) to 0.625 in (1.6 cm), with the ribs disposed on a radius of curvature of 8 in (20.3 cm).

Nuts 52 were machined from 4340 high strength steel having a thickness of 0.375 in (0.95 cm).

Keys 48 were machined from 1018 steel, having dimensions of 0.375 in (0.95 cm) by 0.375 in (0.95 cm) by 1.5 in (93.8 cm).

Braze paste was applied to the ribs 26 of the cutters. The paste was formed by blending a dry mixture of 2181 gm of Alloy 828 bronze (Connecticut Engineering, Sandy Hook, Conn.) powder (<44 μm), and 218 gm titanium hydride powder (<44 μm) using a Turbula mixer (Glen-Mills INC, Clifton, N.J.). The dry mixture was then combined with 510 gm of a fugitive liquid binder, Vitta Braze-Gel (Vitta Corporation, Bethel, Conn.) in a stainless steel container until a uniform paste was formed. The paste was applied to the ribs 26 of cutters 22. Diamond grains, 20/30 U.S. mesh (approx. 838 μm), were then sprinkled onto the tacky braze. The coated cutters were air dried then fired under vacuum (<1 mm Hg) in a furnace at 880° C. for 30 minutes. A brazed metal bonded diamond abrasive cutter was thus produced.

The keys 48 were attached to the cutters.

The keyed cutters were placed on the drum (core) 24.

The cutters 22 were secured to the drum with aircraft Grade 8 bolts using curved nuts 52 at torque of 200 ft*lbs. to complete the wheel.

The wheel was spin tested at 2175 rpm and 2560 rpm, respectively 1.5 and 1.765 times the intended rotational speed of 1450 rpm.

The wheel completed the tests successfully, with no dimensional changes evident in the grinding wheel.

In the preceding specification, the invention has been described with reference to specific exemplary embodiments thereof. It will be evident that various modifications and changes may be made thereunto without departing from the broader spirit and scope of the invention as set forth in the claims that follow. The specification and drawings are accordingly to be regarded in an illustrative rather than restrictive sense.

Having thus described the invention, what is claimed is:

1. A drum grinding wheel comprising:

an elongated drum having a central axis;

the drum configured for coaxial engagement with a spindle of a grinding machine;

the drum having an exterior surface extending parallel to the central axis;

a plurality of removable cutters removably fastened to the exterior surface;

each of said cutters having a plurality of ribs disposed in spaced relation thereon; and abrasive grain disposed on a grinding face of each of said ribs.

2. The drum grinding wheel of claim 1, wherein the abrasive grain is disposed in a single layer.

3. The drum grinding wheel of claim 1, wherein the abrasive grain is selected from the group consisting diamond, CBN (cubic boron nitride), fused alumina, sintered alumina, aluminum oxynitride, zirconia-alumina silicon carbide, boron carbide, tungsten carbide, and combinations thereof.

4. The drum grinding wheel of claim 3, wherein the exterior surface has a polygonal transverse cross-section.

5. The drum grinding wheel of claim 4, wherein the sides of the polygonal cross-section define engagement surfaces for said cutters.

6. The drum grinding wheel of claim 5, wherein the cutters are disposed in substantially abutting relationship to one another, the cutters collectively extending substantially continuously about the central axis.

7. The drum grinding wheel of claim 2, wherein each of said cutters has a plurality of ribs disposed in spaced relation thereon, and said abrasive grain is disposed on a grinding face of each of said ribs.

8. The drum grinding wheel of claim 4, wherein the grinding faces are disposed at a predetermined radius from the central axis.

9. The drum grinding wheel of claim 4, wherein the grinding faces form a notional cylinder upon rotation of said drum about the central axis.

10. The drum grinding wheel of claim 8, wherein each cutter has a base configured for engagement with at least one of said engagement surfaces.

11. The churn grinding wheel of claim 10, comprising:

first keyways disposed in said exterior surface;

second keyways disposed in said bases;

said first and second keyways being superposed with one another when the cutters are removably fastened to the drum; and a key disposed within each of said superposed keyways.

12. The drum grinding wheel of claim 11, wherein a key is disposed integrally with each of said second keyways.

13. The drum grinding wheel of claim 10, wherein each cutter is removably fastened to a single one of said engagement surfaces.

14. The drum grinding wheel of claim 13, wherein the grinding faces of the ribs of each cutter collectively define an arcuate portion of the national cylinder.

15. The drum grinding wheel of claim 13, wherein the cutters are removably fastened to the drum with fasteners extending from the cutters through the exterior surface.

16. The drum grinding wheel of claim 15, wherein the fasteners are threaded fasteners threadably engaged with nuts disposed on an interior surface of the drum.

17. The drum grinding wheel of claim 16, wherein said interior surface is substantially cylindrical, and the nuts include an arcuate surface configured for surface to surface engagement with said interior surface.

18. The drum grinding wheel of claim 1 wherein the abrasive grain is disposed in a metal bond matrix.

19. The drum grinding wheel of claim 18 wherein said metal bond comprises a braze selected from the group consisting of bronze, nickel, and alloys thereof.

20. The drum grinding wheel of claim 18 wherein said metal bond comprises a bronze alloy and a material selected from the group consisting of copper, silver, chromium, iron, tungsten, titanium and combinations thereof.

21. The drum grinding wheel of claim 18, wherein said metal bond comprises electroplated metal selected from the group consisting of nickel, copper, cobalt, silver, tin, chromium, and alloys and combinations thereof.

22. The drum grinding wheel of claim 21, wherein the electroplated metal comprises nickel.

23. The drum grinding wheel of claim 21, wherein the alloys are selected from brass, nickel-iron, bronze and nickel tin.

24. The drum grinding wheel of claim 1, wherein the drum is fabricated from a material selected from the group consisting of steel, aluminum, bronze, titanium and Inconel, and alloys, and combinations thereof.

25. The drum grinding wheel of claim 1, wherein the cutter is fabricated from a material selected from the group consisting of steel, titanium and Inconel, and alloys and combinations thereof.

* * * * *